US006213516B1

(12) United States Patent
Ong

(10) Patent No.: US 6,213,516 B1
(45) Date of Patent: Apr. 10, 2001

(54) PRESENTATION CASE

(76) Inventor: Bon S. Ong, Box 4247, Torrance, CA (US) 90510

( * ) Notice: Subject to any disclaimer, the term of this patent is extended or adjusted under 35 U.S.C. 154(b) by 0 days.

(21) Appl. No.: 09/660,232

(22) Filed: Sep. 12, 2000

(51) Int. Cl.[7] ..... B42D 3/00

(52) U.S. Cl. ..... 281/29; 281/37; 281/31; 402/3

(58) Field of Search ..... 402/3, 70, 73, 402/79; 281/15.1, 21.1, 29, 31, 36, 37, 51

(56) References Cited

U.S. PATENT DOCUMENTS 5,720,564 * 2/1998 Winzen ..... 402/3
5,795,089 * 8/1998 Ong ..... 402/79
5,876,143 * 3/1999 Ong ..... 402/3
5,882,038 * 3/1999 Ong ..... 281/31

* cited by examiner

*Primary Examiner*—Willmon Fridie, Jr.
(74) *Attorney, Agent, or Firm*—Charles H. Thomas

(57) ABSTRACT

A document presentation folder is formed from a base sheet of stiff material and a front cover. The front cover is formed with an exposed outer sheet of a nonopaque material and an inner sheet that forms a pocket with the outer sheet. The base sheet is folded in articulated fashion to define a spine demarcation and a narrow front cover attachment strip which has an attachment edge. One side of the outer front cover sheet is positioned against and overlaps the portion of the front cover attachment strip immediately adjacent thereto. The outer cover sheet and the front cover attachment strip of the base sheet are attached together by a single, continuous linear heat seal. A title sheet is removably inserted into the pocket defined between the inner and outer sheets of the front cover. A printed indicia on the face of the title sheet is thereby clearly visible through the nonopaque outer sheet of the front cover. The title sheet may be changed at will providing the document binder with a user-selected title or other indicia of contents. The size of the pocket is configured to snugly receive a standard eight and a half by eleven inch sheet of paper as a title sheet.

17 Claims, 5 Drawing Sheets

PRESENTATION CASE

BACKGROUND OF THE INVENTION

1. Field of the Invention

The present invention relates to a document folder upon which a title sheet containing printed material visible from the exterior of the folder may be changed.

2. Description of the Prior Art

In business and industry many sales are made to prospective customers utilizing documents in the nature of business proposals, customized sales proposals, or other documents intended for presentation to specific businesses or governmental organizations. In presenting proposals of this type it is quite desirable to identify the document as having been prepared especially for presentation to a specific entity. This may best be done by including the name or other identifying indicia of the entity for whom the document is intended for presentation on the front cover of the document.

This practice has several advantages. By printing the name of the entity for which the proposal has been prepared on the cover, it becomes apparent to the decision making individuals within that entity that some time and effort has been spent in considering the specific needs and requirements of the entity for which the proposal has been prepared. That is, it is apparent that the proposal is not just a general item of promotional material that would be given to any prospective business customer. The entity preparing and presenting such a customized proposal is therefore more likely to have greater credibility in the minds of the decision-making individuals receiving the proposal insofar as the perceived depth of understanding of the unique needs and requirements of the receiving entity are concerned.

The use of an individual title of the intended recipient of a business proposal also has advantages to individuals dealing with the proposal document on behalf of the entity preparing and presenting the document. A title identifying the intended recipient of the intended proposal serves to differentiate the particular form and substance of a proposal prepared for one intended recipient from similar, yet somewhat different, variations of the proposal that may have been prepared for presentation to other intended recipients. Thus, a unique title that is visible even before the proposal folder is opened ensures that the presenting individual brings to the intended recipient only those copies of a general presentation approach that have been uniquely modified for a particular intended recipient.

One difficulty in customizing document folders for use with particular intended recipients is the relatively great expense of printing a title on a cover of a single or a small number of document folders. According to conventional construction techniques, documents folders are typically formed from a single, die-cut sheet of thick paper or card stock. Once cut, the sheets of card stock are folded according to particular patterns. In the simplest form a folder may be merely creased in half to form a stiff front and back cover joined to each other by a spine fold demarcation. However, often the sheet of stock from which the folder is formed is cut so as to additionally define reinforcement margins, pockets, and sometimes interior binding folds. In any event, the die-cut sheet of stock, in its flat form before folding, is typically significantly larger than a standard sheet of paper, which may be eight and a half by eleven inches, eight and a half by thirteen inches, eight and a half by fourteen inches, or A4 size.

At present, most conventional computer-operated printers are designed to receive only standardized sizes of stock having the dimensions of typical, standard size, paper sheets. As a consequence, a document folder cannot be fed through a conventional computer-operated printer, such as a laser printer, in its unfolded form because the flattened sheet of stock is simply too large to pass through the printer. On the other hand, once the sheet of stock is folded to define the covers and possibly pockets within a folder, the folded sheet of stock is too thick to pass through a conventional, computer-operated printer without jamming. As a consequence, folders can only be printed on their surfaces with special purpose, expensive printing machines. While it may be economical to print a large number of folders with the same title on such special purpose printing machines, the economic cost of printing only a small number of folders using such special-purpose printing machines ordinarily cannot be justified.

One approach to providing a document with a title indicating the intended recipient is to package the presentation materials within a folder having a transparent front cover. The title is then printed on the top page of the documents within the folder and the contents of the folder are then bound between the covers. Since the top cover is transparent, the title of the presentation materials is visible through the transparent front cover. Because the title is printed on the top sheet of a standard size sheet of paper, it can easily pass through a conventional, computer-operated printer which can print small quantities of documents economically. However, a folder of this type is disadvantageous in that it lacks the pockets that can be easily created using plastic sheets, a card stock or stiff paper stock sheet of material in the folder construction. Also, the cost of the transparent cover adds to the expense of the folder. Furthermore, the transparent material forming the cover is often considerably less stiff than the plastic sheet material, the thick paper stock or card stock material employed to form conventional presentation folders.

Another approach to providing a card stock or thick paper stock folder with a customized cover is to form a window in the front cover and to position a sheet of paper bearing the title within the folder as the top sheet in a stack of presentation materials. The title on this sheet is thereby visible through the title window formed in the cover. However, quite often materials within the folder become rearranged so that the title page is covered up by other sheets which should be located behind the title page. As a consequence, printed material that clearly is not a title will often erroneously appear in the title window in the front cover. This greatly detracts from the impression created by the presentation folder since instead of appearing as a document entitled for and carefully prepared for use by a particular entity, the folder appears to encase a disorganized assemblage of materials.

Still another approach to providing a card stock or thick paper stock folder with a title is to print the title on a title label, and to attach the label, typically by means of adhesive, to the exterior surface of the front cover. While title labels of this type can be printed economically in this way, the use of a label attached adhesively to the front cover renders the folder less professional in appearance. Also, the use of adhesive labels adds an additional step to the assembly of the folder, since the adhesive label must be activated, either by pressure or moisture, and pressed against the exterior surface of the cover. This additional step is normally performed manually. As a result, placement of a label crooked or in a nonuniform manner on several copies of the presentation materials is not uncommon.

SUMMARY OF THE INVENTION

One primary object of the present invention is to provide a presentation case or folder with a title sheet that can be easily viewed and which can be easily changed when desired. In this connection the invention provides a system by which the title sheet is protected from accidental dislodgement in the use of the presentation case. The presentation case of the invention provides a system in which a removable title sheet can be easily viewed when the case is closed and removed and replaced when desired. Nevertheless, the title sheet is held firmly in position even when the case is subjected to rough treatment.

Another object of the invention is to provide a presentation case or document binder in which the title sheet can be easily customized by replacement with an alternative sheet having a different title. This allows the same binder to be used for presentations to different customers or presentations containing numerous different reports having different titles.

Still another object of the invention is to provide a presentation folder with a nonopaque front cover which is not subjected to damage by contact with a ring binder mechanism, a prolonged fastener mechanism, or other mechanical devices typically located on the inside surface of the spine panel of a presentation case or report folder.

In one broad aspect the present invention may be considered to be a presentation document folder comprising: a rectangular back and spine cover, and a front cover formed of inner and outer sheets. The back and spine cover defines mutually parallel top and bottom edges, a spine demarcation, a front cover attachment edge, and a free edge remote from the front cover attachment edge. The free edge, the spine demarcation, and front cover attachment edge are parallel to each other and perpendicular to the top and bottom edges. A portion of the back and spine cover adjacent the spine demarcation is folded back on the remaining portion of the back and spine cover to delineate a narrow front margin strip that extends between the top and bottom edges and between the spine demarcation and front cover attachment edge. The front cover has a rectangular perimeter and is formed of inner and outer sheets disposed in mutually facing relationship and having sealed edges secured together along three sides of the rectangular perimeter. The inner and outer sheets have unsecured edges at the fourth side of the rectangular cover perimeter to define a pocket between them. The outer sheet is nonopaque and has opposing longitudinal edges. The front cover sheet is permanently sealed throughout its length at one of its longitudinal edges to the front margin strip at the front cover attachment edge thereof.

In another broad aspect the invention may be considered to be a document presentation binder comprising a binder body, a front cover, and a title sheet. The binder body is form of a sheet of stiff cover material folded in articulated fashion to form an expansive back cover, a narrow spine cover hinged to the back cover, and a narrow front margin strip hinged to the spine cover and having a linear spine demarcation and an opposite front cover attachment edge. The front cover is formed of inner and outer front cover sheets. The outer front cover sheet has a rectangular perimeter and is formed of a nonopaque material and is permanently secured to the front cover margin strip at the front cover attachment edge throughout the length thereof. The inner front cover sheet is secured to a portion of the perimeter of the outer sheet to define a pocket between the inner and outer front cover sheets. The title sheet is removably disposed in the pocket and bears contents indica thereon externally visible through the outer front cover sheet.

In still another aspect the invention may be considered to be a presentation folder comprising a base sheet of stiff material, a front cover, and a title sheet. The base sheet has opposing mutually parallel top and bottom edges. The base sheet is folded longitudinally to define a back cover, a spine, and a narrow front cover attachment strip overlying a narrow portion of the back cover adjacent the spine. The front cover is formed of an outer, exposed sheet of nonopaque material secured to the front cover attachment strip throughout the length thereof. The front cover is also formed with an inner sheet secured to the outer exposed sheet about a portion of the perimeter thereof to define a pocket between the inner and outer sheets. The title sheet is removably positionable within the pocket and contains indicia thereon that is visible through the outer exposed sheet.

In a preferred embodiment of the invention, the base sheet forming the back and spine cover and the front cover are both formed of a stiff polyethylene plastic sheets. Also, the front cover is preferably heat sealed to the front margin strip with a continuous linear seal that extends between the top and bottom edges of the base sheet immediately adjacent to the front cover attachment edge. The outer sheet of the front cover is either translucent or transparent.

It is sometimes desirable to form a plurality of mounting slits in the inner sheet of the front cover. The mounting slits are arranged to receive corners of a card, such as a business card, placed against the inner sheet of the front cover.

While the unsealed edge of the inner and outer sheets of the front cover may reside along any side of the rectangular perimeter of the front cover, they preferably lie adjacent and parallel to the front cover attachment edge of the front margin strip. In this way the title sheet can be inserted into the open mouth of the pocket when the front cover is open from the direction of the spine of the binder. The pocket preferably has a width of between about eight and a half and about nine inches and a length of between about eleven and a half and about twelve inches. A pocket of this size readily accommodates a title sheet printed on a standard size eight and a half by eleven inch sheet of paper.

The invention may be described with greater clarity and particularity by reference to the accompanying drawings.

DESCRIPTION OF THE EMBODIMENT

Figure 1:
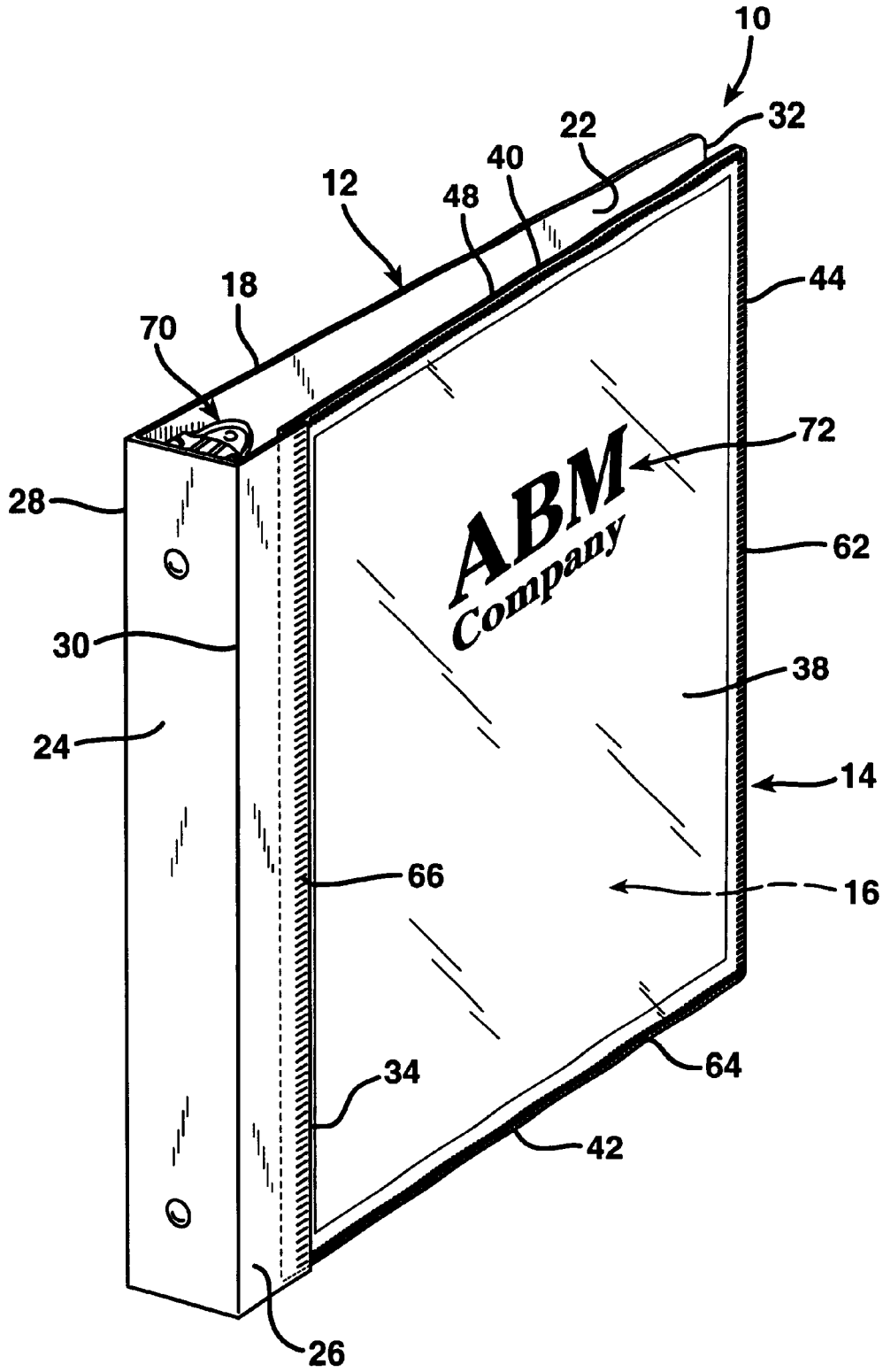
FIG. 1 is a perspective view illustrating one preferred embodiment of a presentation document folder constructed according to the invention.
Figure 2:
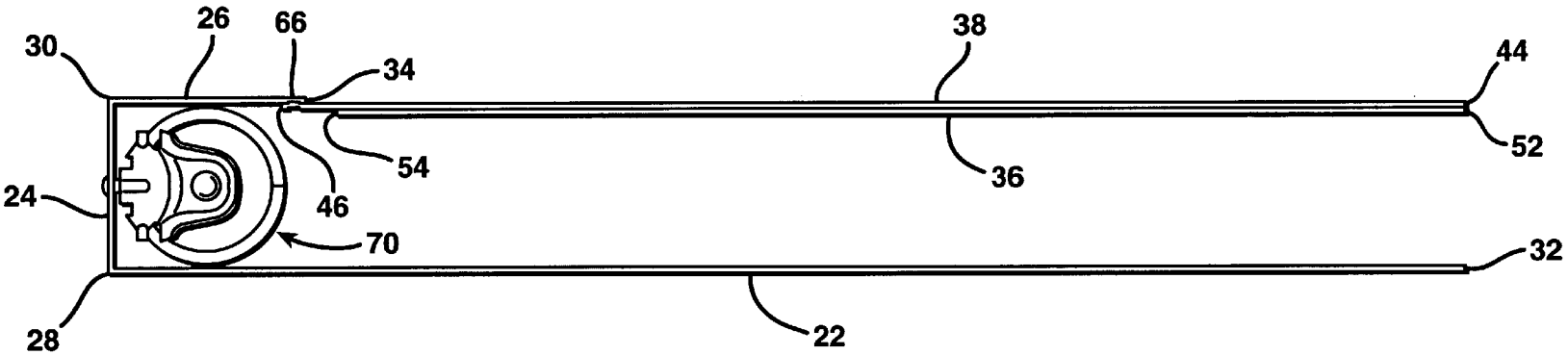
FIG. 2 is an end view of the presentation document folder of FIG. 1.

FIG. 1 illustrates a document binder or presentation folder indicated generally at 10. The folder or binder 10 is formed with a binder body 12, a front cover 14, and a title sheet 16. The binder body 12 is form of a base sheet of stiff cover material, such as a stiff, colored rectangular sheet of polyethylene about twenty mils in thickness and having a width of about thirteen and a half inches and a length of about eleven and five-eighths inches. The base sheet 12 has opposing top and bottom edges 18 and 20, respectively.

The binder body 12 is folded longitudinally to form an expansive back cover 22 about ten and a half inches in width, a narrow spine cover 24 of about one and one-half inches in width, and a front margin strip 26, which is also about one and a half inches in width. The spine cover 24 is delineated by linear spine demarcations 28 and 30 that extend the entire distance between the top edge 18 and bottom edge 20. The spine demarcations 28 and 30 are formed as creases or hinge connections within the structure of the binder body 12. The spine demarcation 28 delineates the spine cover 24 from the back cover 22 and lies remote from the free edge 32 of the back cover 22. The spine demarcation 30 delineates and forms a hinge connection between the spine cover 24 and the front margin strip 26. The front margin strip 26 is bounded on one side by the spine demarcation 30 and along its opposite side by a front cover attachment edge 34 that is parallel to the spine demarcation 30.

The front cover 14 is formed of an inner rectangular, plastic sheet of material 36 and an outer plastic sheet 38 which has a greater thickness then the inner sheet 36. The outer sheet 38 is preferably about twenty mils in thickness, about nine and one-eighth inches in width, and about eleven and five-eighths inches in length, as measured between its top edge 40 and bottom edge 42. The outer sheet 38 may, for example, be formed of a colorless, translucent sheet of polyethylene. The outer cover sheet 38 has a longitudinally extending free edge 44 and an opposing longitudinal attachment edge 46.

The inner sheet 36 of the front cover 14 may have a thickness of about ten mils and may be formed of clear, transparent polyethylene plastic. The inner sheet 36 is also about ten and five-eighths inches in length, but is not quite as wide as the outer sheet 38. The inner sheet 36 may, for example, have a width of about nine and three-quarters inches.

Figure 3:
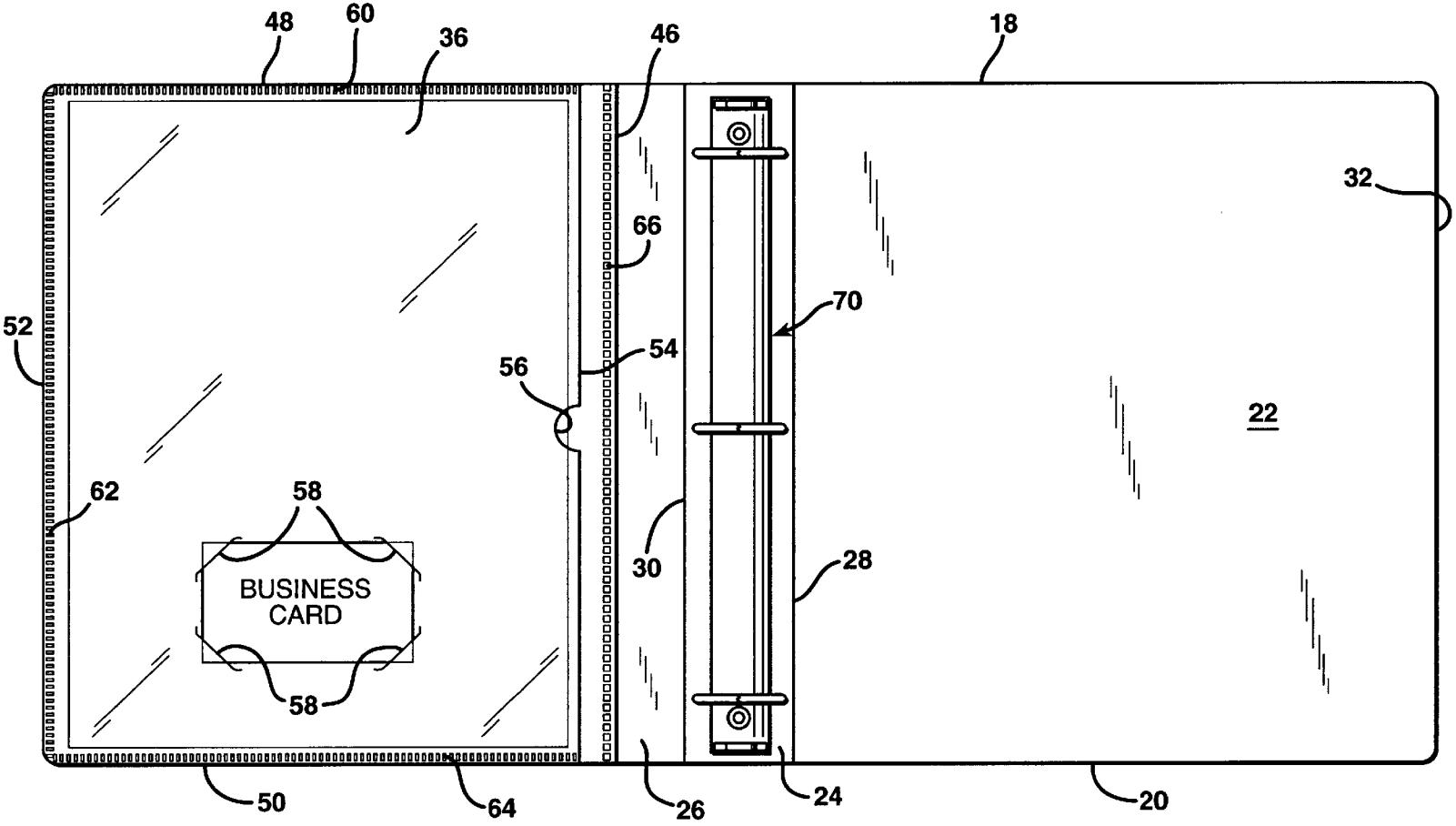
FIG. 3 is a plan view of the presentation document folder of FIG. 1 shown in a fully opened condition as viewed from the inside of the folder.

The inner sheet 36 has an outer, longitudinally extending outer edge 52 and an opposing longitudinally extending inside edge 54 located closely adjacent to the front cover attachment edge 34, although the outer front cover sheet 38 separates the inner front cover sheet 36 from any contact with the binder body 12. A semicircular finger grip process 56 is defined in the inner longitudinal side edge 54 of the inner cover sheet 36. Four short card-mounting slits 58 are defined in the inner front cover sheet 36. The slits 58 are diagonally oriented relative to the top edge 48 and bottom edge 50 and relative to the outer side edge 52 and the inner side edge 54 of the inner front cover sheet 36 as illustrated in FIG. 3. The slits 58 are oriented so as to receive the four corners of a business card placed against the exposed face of the inner sheet 36.

Figure 5:
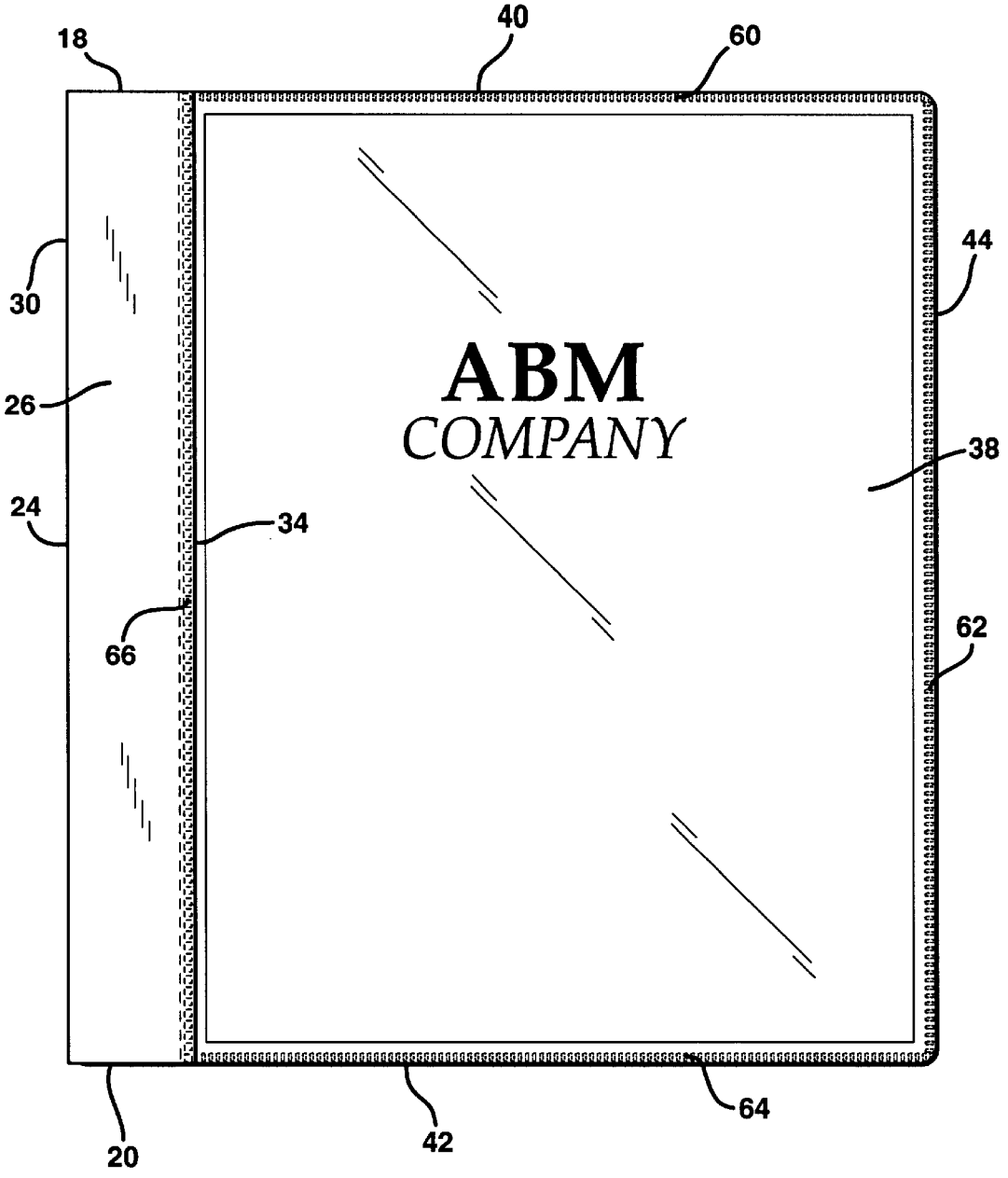
FIG. 5 is a plan view from the exterior of the presentation document folder of FIG. 1 showing the front cover and the front margin strip.

The inner sheet 36 and the outer sheet 38 of the front cover 14 are placed against each other so that the top edges 48, 40; the bottom edges 50, 42; and the outside edges 44–52; the outer sheet 38 and the inner sheet 36 of the front cover 12 are respectively congruent to each other. The three sides of the rectangular sheet 36 and 38 defined by these edges are heat sealed together by heat seals 60, 62, and 64, as illustrated in FIGS. 3 and 5. The fourth and remaining edges of the inner sheet 36 and the outer sheet 38 are left unsealed to form the mouth of a pocket between the inner sheet 36 and the outer sheet 38 of the front cover 14.

The longitudinal border of the outer cover sheet 38 immediately adjacent its longitudinal side edge 46 overlaps the corresponding longitudinal border of the front margin strip 26 immediately adjacent its attachment edge 34. The front cover outer sheet 38 and the front margin strip 26 thereby overlap each other a distance of about one quarter of an inch. The outer sheet 38 of the front cover 14 is heat sealed to the front margin strip 26 of the binder body 12 by a longitudinal, continuous line of heat sealing 66, visible in FIGS. 3 and 5. The continuous heat seal 66 extends the entire distance from the top edges 18 and 40 to the bottom edges 20 and 42 of the binder body 12 and outer cover sheet 38, respectively. The outer front cover sheet 38 is thereby heat sealed to the front margin strip 26 immediately adjacent to the front cover attachment edge 34.

The pocket defined between the inner and outer front cover sheets 36 and 38 has a width of between about eight and a half and about nine inches and a length of between about eleven and a half and about twelve inches. The longitudinal attachment edge 46 of the outer front cover sheet 38 and the unsealed edge 54 of the inner front cover sheet 36 both lie adjacent and parallel to the front cover attachment edge 34 of the front margin strip 26. As a result, the open mouth of the pocket 61 also lies closely adjacent and parallel to the front cover attachment strip 26.

In the document folder 10 illustrated in the drawings the base sheet 12 defines a spine panel 24 that is at least about one inch in width and which lies between the back cover 22 and the front cover attachment strip 26. A conventional three ring binder mechanism 70 is mounted on and permanently secured to the inside surface of the spine panel 24. It should be noted that with the construction described, the rings of the ring binder mechanism 70 do not contact any portion of front cover 14. Rather, the binder rings contact the more durable structure of the binder body 12 rather than the structure of the front cover 14.

Figure 4:
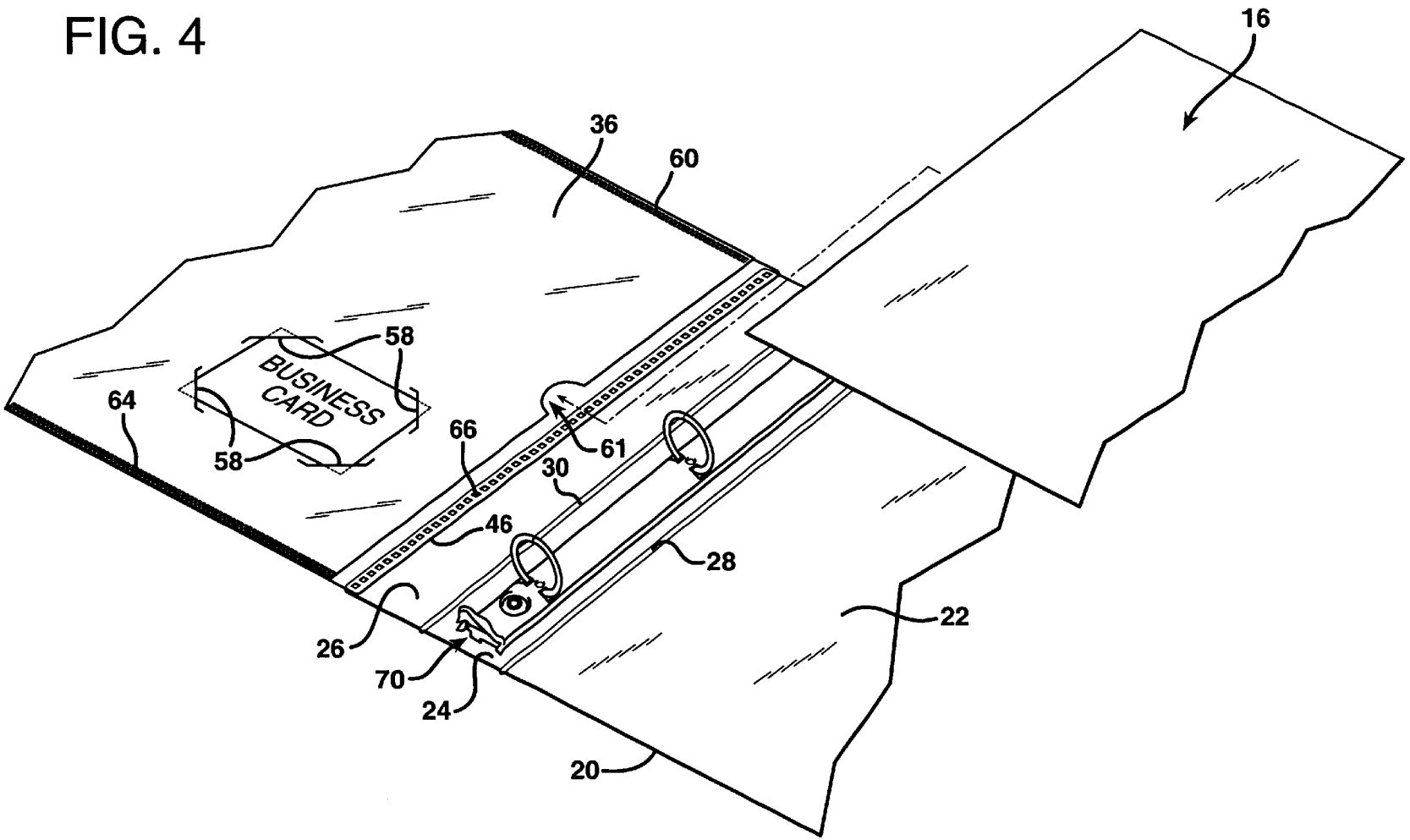
FIG. 4 is a perspective view illustrating insertion of the title sheet into the front cover pocket of the presentation document folder of FIG. 1.

FIG. 4 of the drawings illustrates the manner in which the title sheet 16 may be inserted into and removed from the pocket defined between the inner and outer sheets 36 and 38 of the front cover 14. Specifically, a user merely opens the folder 10, lifts the inside edge 54 of the inner front cover sheet 36, typically utilizing the finger notch 26 for this purpose. The user then inserts one long edge of the title sheet 16 into the pocket. The smooth plastic surfaces of the inner sheet 36 and outer sheet 38 are quite slick so that the title sheet 16 slides easily into the pocket. Title indicia 72 printed on the side of the title sheets residing in contact with the inner surface of the outer sheet 38 of front cover 14 is thereupon highly visible through the translucent layer formed by the outer front cover sheet 38, as illustrated in FIGS. 1 and 5. The title sheet 16 fits snugly within the pocket defined between the inner and outer sheets 36 and 38 of front cover 14, so that it is very nearly totally immobilized within the structure of the front cover 14. This aids in maintaining a professional, high-quality appearance for the binder 10.

Undoubtedly, numerous variations and modifications of the invention will become readily apparent to those familiar with office supply products. For example, a binder or folder having a single spine demarcation between the back cover and the front cover attachment margin may be constructed according to the invention. The existence of any spine panel, such as the spine panel 24, is not essential to the invention. On the other hand, if the spine panel is employed, any conventional type of fastener, such as a prong fastener mechanism, may be utilized in place of the ring binder 70 illustrated in the drawings. Also, while the mouth of the pocket between the inner and outer sheets of the front cover is preferably immediately adjacent to the front cover attachment edge, the mouth of the pocket may be formed between the top edges, the bottom edges, or even the outside edges of the two layers of the sheets forming the front cover. Also, while both the base sheet 12 and the front cover 14 of the invention have been described as being rectangular, it is understood that their corners do not need to form right angles, but can be quite rounded. Other variations and modifications are also within the scope of the invention. Accordingly, the scope of the invention should not be construed as limited to the specific embodiment depicted and described, but rather is defined in the claims appended hereto.

I claim:

1. A document folder comprising:

a rectangular back and spine cover defining mutually parallel top and bottom edges, a spine demarcation, a front cover attachment edge, and a free edge remote from said front cover attachment edge, and said free edge, said spine demarcation and said front cover attachment edge are parallel to each other and perpendicular to said, top and bottom edges, and a portion of said back and spine cover adjacent said spine demarcation is folded back upon the remaining portion of said back and spine cover to delineate a narrow front margin strip that extends between said top and bottom edges and between said spine demarcation and said first cover attachment edge, a front cover having a rectangular perimeter and formed of inner and outer sheets disposed in mutually facing relationship and having sealed edges secured together along three sides of said rectangular perimeter and unsecured edges at a fourth side thereof to define a pocket between said inner and outer sheets, and said outer sheet is nonopaque and has opposing longitudinal edges, and is permanently sealed throughout its length at one of said longitudinal edges to said front margin strip at said front cover attachment edge thereof.

2. A document folder according to claim 1 wherein said back and spine cover defines a spine panel having a width of at least about one inch and further comprising a ring binder mechanism permanently secured to said spine panel.

3. A document folder according to claim 1 wherein said back and spine cover and said front cover are both formed of plastic, and said front cover is heat sealed to said front margin strip with a linear seal immediately adjacent to said front cover attachment edge.

4. A document folder according to claim 1 wherein said outer sheet of said front cover is translucent.

5. A document folder according to claim 1 wherein said outer sheet of said front cover is transparent.

6. A document folder according to claim 1 wherein a plurality of mounting slits are defined in said inner sheet of said front cover and are arranged to receive corners of a card placed against said inner sheet.

7. A document folder according to claim 1 wherein said unsealed edges of said inner and outer sheets of said front cover lie adjacent and parallel to said front cover attachment edge of said front margin strip.

8. A document folder according to claim 1 wherein said pocket has a width of between about a eight and one-half and about nine inches and a length of between about eleven and one-half and about twelve inches.

9. A document binder comprising:

a binder body formed of a sheet of stiff cover material folded in articulated fashion to form an expansive back cover, a narrow spine cover hinged to said back cover, and a narrow front margin strip hinged to said spine cover and having a linear spine demarcation and an opposite front cover attachment edge, and a front cover formed of inner and outer front cover sheets, and said outer front cover sheet has a rectangular perimeter and is formed of a nonopaque material and is permanently secured to said front margin strip at said front cover attachment edge throughout the length thereof, and said inner front cover sheet is secured to a portion of said perimeter of said outer sheet to define a pocket between said inner and outer front cover sheets, and a title sheet removably disposed in said pocket and bearing contents indicia thereon externally visible through said outer front cover sheet.

10. A document binder according to claim 9 wherein both said binder body and said front cover are formed of sheets of stiff plastic and said outer front cover sheet is heat sealed to said front margin strip immediately adjacent said front cover attachment edge.

11. A document binder according to claim 10 wherein said inner front cover sheet is also formed of plastic and is heat sealed to said outer front cover sheet.

12. A document binder according to claim 9 wherein said outer front cover sheet is translucent.

13. A presentation folder comprising:

a base sheet of stiff material having opposing mutually parallel top and bottom edges and which is folded longitudinally to delineate a back cover, a spine, and a narrow front cover attachment strip overlying a narrow portion of said back cover adjacent said spine, a front cover formed of an outer exposed sheet of nonopaque material secured to said front cover attachment strip throughout the length thereof, and an inner sheet secured to said outer exposed sheet about a portion of the perimeter thereof to define a pocket between said inner and outer sheets, and a title sheet removably positionable within said pocket and containing indicia thereon that is visible through said outer exposed sheet.

14. A presentation folder according to claim 13 wherein said base sheet is formed of opaque plastic and said outer exposed sheet of said front cover is formed of translucent plastic, and said outer exposed sheet of said front cover and said front cover attachment strip of said base sheet are joined together by a continuous, linear heat seal that extends between said top and bottom edges of said base sheet.

15. A presentation folder according to claim 14 wherein said base sheet defines a spine panel at least about one inch in width which lies between said back cover and said front cover attachment strip, and a ring binder mechanism is mounted on said spine panel.

16. A presentation folder according to claim 13 wherein said pocket has an open mouth that lies closely adjacent and parallel to said front cover attachment strip.

17. A presentation folder according to claim 13 wherein said pocket has a width of between about eight and one-half and about nine inches and a length of between about eleven and one-half and about twelve inches.

* * * * *